US005570669A

United States Patent [19]

Regueiro

[11] Patent Number: 5,570,669

[45] Date of Patent: Nov. 5, 1996

[54] CYLINDER HEAD FOR AN OVERHEAD CAMSHAFT INTERNAL COMBUSTION ENGINE

[75] Inventor: Jose F. Regueiro, Rochester Hills, Mich.

[73] Assignee: Chrysler Corporation, Auburn Hills, Mich.

[21] Appl. No.: 567,018

[22] Filed: Dec. 4, 1995

[51] Int. Cl.[6] ..... F02B 17/00

[52] U.S. Cl. ..... 123/193.5

[58] Field of Search ..... 123/193.5, 193.3, 123/90.27

[56] References Cited

U.S. PATENT DOCUMENTS

| | | | |
|---|---|---|---|
| 2,769,438 | 11/1956 | Witzky | 123/193.3 |
| 5,094,197 | 3/1992 | Rosa | 123/90.27 |
| 5,095,858 | 3/1992 | Ascari | 123/90.27 |
| 5,462,027 | 10/1995 | Aoyama | 123/193.5 |

*Primary Examiner*—Marguerite McMahon
*Attorney, Agent, or Firm*—Kenneth H. MacLean

[57] ABSTRACT

A cylinder head for an internal combustion engine provided with multiple cylinders and in which the cylinder head has a valve train incorporated therein which includes intake and exhaust valves each of which is associated with an inverted bucket tappet supported for reciprocation in a tappet guide along an axis parallel to the longitudinal axis of the valve and in which the latter mentioned axis is offset from the rotational axis of a camshaft which directly actuates the inverted bucket tappet for causing the valve to open a passage communicating with the associated cylinder of the engine.

3 Claims, 1 Drawing Sheet

CYLINDER HEAD FOR AN OVERHEAD CAMSHAFT INTERNAL COMBUSTION ENGINE

FIELD OF THE INVENTION

This invention concerns overhead camshaft internal combustion engines and, more particularly, is directed to a cylinder head for such engines in which the cylinder head includes a valve train having inverted bucket type tappets the center line of each of which is offset from the centerline of the associated valve.

BACKGROUND OF THE INVENTION

In the case where one desires to have a family of internal combustion engines starting with an engine block provided with a cylinder bore of a predetermined size and having the next engine provided with an engine block which has an increased cylinder bore size, the most opted for approach has been to continue use of the cylinder head for the original engine without changing the valve sizes. This approach inevitably results in the power output and fuel efficiency of the larger bore engine falling short of what both could have been had the valves been enlarged in proportion to the increase in bore size. An expensive alternative is to redesign the whole cylinder head. However, even that solution is not always possible because the tappet centers must change with respect to the cylinder centers with a corresponding change to the camshaft centers and to the cam gear diameters in geared double-overhead camshaft trains. Also, changes of this sort may not be possible due to space requirements dictated by cylinder head bolt sizes and location and underhood clearances.

An even worse situation exists if it becomes desirable to start with an engine having a cylinder bore of a predetermined size and having the next engine provided with a cylinder bore which is to be reduced in size. In such case, only two possibilities exit. The first is to redesign the entire cylinder head with smaller valves. This is not only very expensive, as mentioned above but, sometimes, is extremely difficult because the camshaft and the tappet bores crowd the spark plug or fuel injector. Moreover, reducing the tappet diameter as a possible solution results in a reduction in the valve lift or the camshaft diameter which may not be acceptable.

The second possibility is to reduce the valve size in proportion to the bore size reduction without moving the valve center relative to the center of the cylinder. This solution, however, would be unacceptable to an engine designer because it would result in the power output of the engine suffering a major reduction due to the fact that each valve has its diameter reduced at least by the same numerical (not proportional) amount that the cylinder bore diameter is reduced.

SUMMARY OF THE INVENTION

Accordingly, a less expensive and more technically acceptable solution is required to the above problem, and one objective of this invention is to provide such a solution. In this regard, I have found that by offsetting the centerlines of the valve and the tappet in a substantially radial outward direction from the centered spark plug or injector an amount roughly equal to one-forth of the difference between the bore diameter of two similar engines with two different bore diameters, it is possible to install appropriate valve sizes in each engine without disturbing positions of the tappet or the camshaft in the cylinder head. In other words, only the valve centers need be shifted in position.

In the preferred form, this is accomplished in accordance with the invention by a cylinder head for an overhead camshaft internal combustion engine having an engine block provided with a plurality of cylinders. A valve train is incorporated in the cylinder head and is operatively associated with each of the cylinders and includes at least one intake valve and one exhaust valve. The intake valve and the exhaust valve each have a valve stem having a longitudinal axis and is located in a valve stem guide which forms a part of the cylinder head. One end of the valve stem is formed with a valve head for opening and closing a passage communicating with a port formed in the cylinder head with the combustion chamber of the associated cylinder. In addition, the cylinder head is formed with a tappet guide opening above the valve stem guide, and the other end of the valve stem is located in the tappet guide opening and has a retainer secured thereto and a spring biases the retainer in a direction to cause the valve to normally close the passage. An inverted bucket tappet is located in the tappet guide opening for reciprocation along an axis parallel to the longitudinal axis of the valve stem and also contacts the other end of the valve stem. The arrangement is such that the overhead camshaft has its rotational axis offset from the longitudinal axis of the valve stem and has a lobe directly contacting the inverted bucket tappet along a line spaced from the center of the tappet for causing the valve head to open the passage against the bias of the spring upon rotation of the camshaft.

The objects of the present invention are to provide a new and improved cylinder head for an internal combustion engine in which the cylinder head is provided with a valve train in which the longitudinal center axis of each valve is parallel to and offset from the longitudinal center axis of the associated tappet; and to provide a new and improved cylinder head for an internal combustion engine provided with multiple cylinders and in which the cylinder head has a valve train incorporated therein which includes intake and exhaust valves each of which is associated with an inverted bucket tappet supported for reciprocation in a tappet guide along an axis parallel to the longitudinal axis of the valve and in which the latter mentioned axis is offset from the rotational axis of a camshaft which actuates the inverted bucket tappet for causing the valve to open a passage communicating with the associated cylinder of the engine.

BRIEF DESCRIPTION OF THE DRAWINGS

The above objects, features and advantages of the present invention will be more apparent from a reading of the following detailed description when taken with the drawings in which.

DETAILED DESCRIPTION OF THE INVENTION

Figure 1:
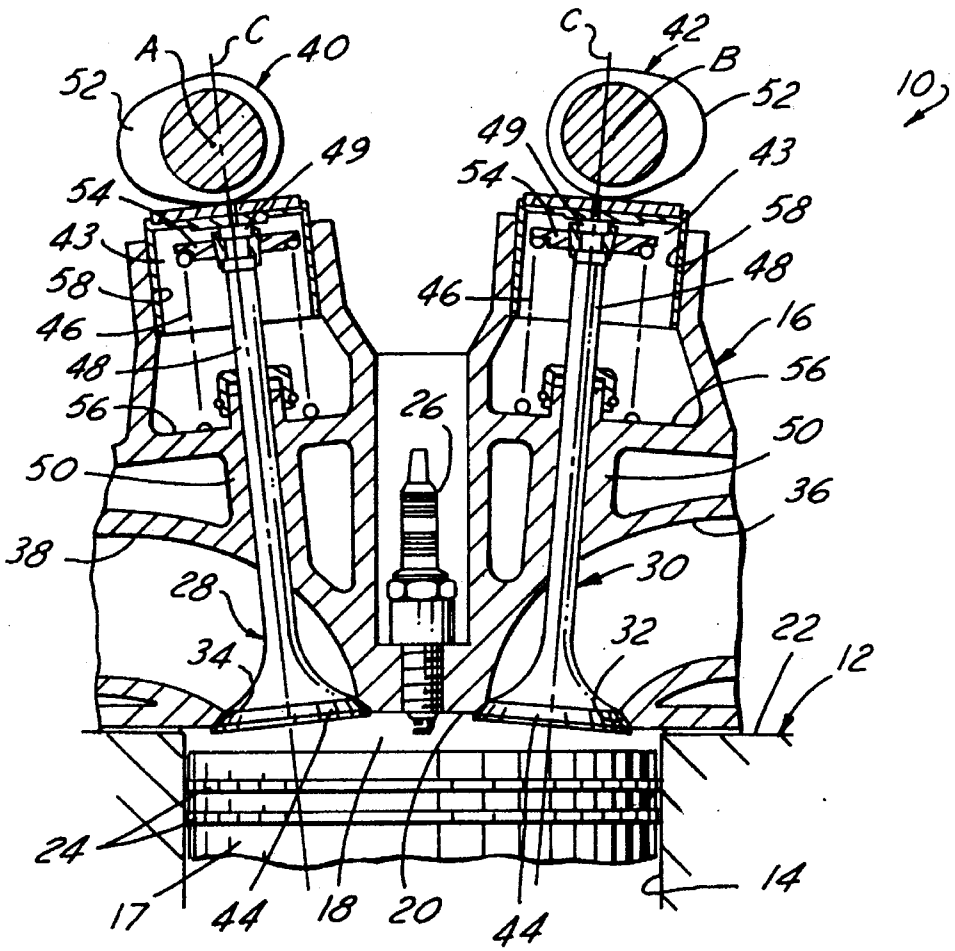
FIG. 1 is a cross-sectional view of a cylinder head made in accordance with the present invention.

Referring to the drawings and more particularly to FIG. 1 thereof, a portion of a multi-cylinder internal combustion engine of the spark-ignition type is shown in cross-section and is generally identified by the reference numeral 10. The internal combustion engine 10 includes a conventional engine block 12 having one or more aligned cylinder bores formed therein (only one of which is shown and is identified by reference numeral 14) and has a new and improved cylinder head 16 according to the present invention mounted thereon. The cylinder bore 14 and each of the other cylinder bores has a piston 17 supported in a conventional manner for reciprocation relative thereto and together with the top end of the piston 17 forms a combustion chamber 18 at the upper end of the cylinder bore 14 with a lower surface 20 of the cylinder head 16 forming the upper end of the combustion chamber 18.

It will be noted that inasmuch the engine block, pistons and the various operating components normally associated therewith are well known to those skilled in the art of engine design, a detailed showing and description of such parts and components is not being provided herein. Instead, the heart of the invention, namely the cylinder head construction and the valve train associated therewith will now be described in detail.

As seen in FIG. 1, the engine block 12 includes a top surface 22 to which the cylinder head 16 is secured in the usual manner by a plurality of fasteners (not shown). As is common with engines of this type, the piston 17 and cylinder bore 14 have a circular cross section with vertically spaced annular rings 24 being provided on the piston 17. As also is conventional, the cylinder head 16 provides a cover for all of the cylinders so that when combustion occurs within the combustion chamber 18 of each cylinder, the associated piston is forced downwardly by the expanding gas generated by the combustion of the fuel and air.

A spark plug 26 is secured in the lower portion of the cylinder head 16 and is positioned centrally relative to an exhaust valve 28 and an air intake valve 30. The spark plug 26 extends through the cylinder head 16 in a manner so that the sparking end of the spark plug 26 is located within the combustion chamber 18. It will be noted that in the case of a diesel engine, the spark plug would be replaced with a fuel injector.

The lower end of the cylinder head 16 is formed with an intake port 32 and an exhaust port 34 that are associated with each cylinder of the engine 10. As seen in FIG. 1, the intake port 32 provides communication between an intake passage 36 and the combustion chamber 18. Similarly, the exhaust port 34 provides communication between the combustion chamber 18 and an exhaust passage 38. Each of the passages 36 and 38 extend through the width of the cylinder head 16. Thus, the intake port 32 is used as the passageway to allow air and fuel to enter the cylinder where it is combusted. The exhaust port 34 allows the products of the combustion process to exit the engine 10 via the exhaust passage 38.

In general, the valve train provided in the cylinder head 16 at each combustion chamber 18 of the engine 10 includes a pair of laterally spaced camshafts 40 and 42, the pair of air intake valves 30, the pair of exhaust valves 28, and an inverted bucket tappet 43 operative associated with each valve. The camshafts 40 and 42 are respectively supported by camshaft bearing saddles and camshaft caps (neither of which is shown) for rotation about a pair of parallel axes which extend longitudinally of the engine 10 and as seen are located in a common horizontal plane.

As best seen in FIG. 1, each of the valves 28 and 30 is provided with a valve head 44 which is normally maintained in a closed position relative to its associated port by a compression spring 46. In addition, each of the valves 28 and 30 has a valve stem 48 located in a valve stem guide 50 which, in this case, forms a part of the cylinder head 16 and serves to guide the associated valve through the course of motion between its fully open position and its fully closed position.

As is conventional, the valve head 44 of the exhaust valve 28 cooperates with an annular valve seat (which defines the port 34) formed or inserted in the lower portion of the cylinder head to open and close the port 34 leading to the exhaust passage 38. Similarly, the valve head 44 of the intake valve 30 cooperates with a valve seat (which defines the port 32) to open and close the port 32 leading to the intake passage 36.

Each of the camshafts 40 and 42 is formed with cam lobes 52 which are adapted to directly engage the associated tappets 43. As each of the camshafts 40 and 42 rotate, the cam lobes 52 press the valves 28 and 30 downwardly so as to cause opening of the intake ports 32 and the exhaust ports 34 against the bias of the coil spring 46 one end of which abuts a retainer 54 secured to the upper end of the stem 48 of the associated valve by a conventional two-piece lock 49. The other end of the coil spring 46 is seated on a flat surface 56 provided in the cylinder head 16 and surrounding the upper portion of the valve stem guide 50. The rotary motion of the cam lobes 52 is translated to reciprocating motion of the valves 28 and 30 through the inverted bucket tappets 43. Each of the tappets 43 is cylindrical in configuration and is slidably disposed for up and down reciprocal movement in a similarly shaped tappet bore 58 formed and machined as upwards extensions of the cylinder head 16. Alternately, the tappet bores 58 can be formed in a separate part of the cylinder head that may also carry the camshafts, such part being normally identified a cam and tappet carrier.

Figure 2:
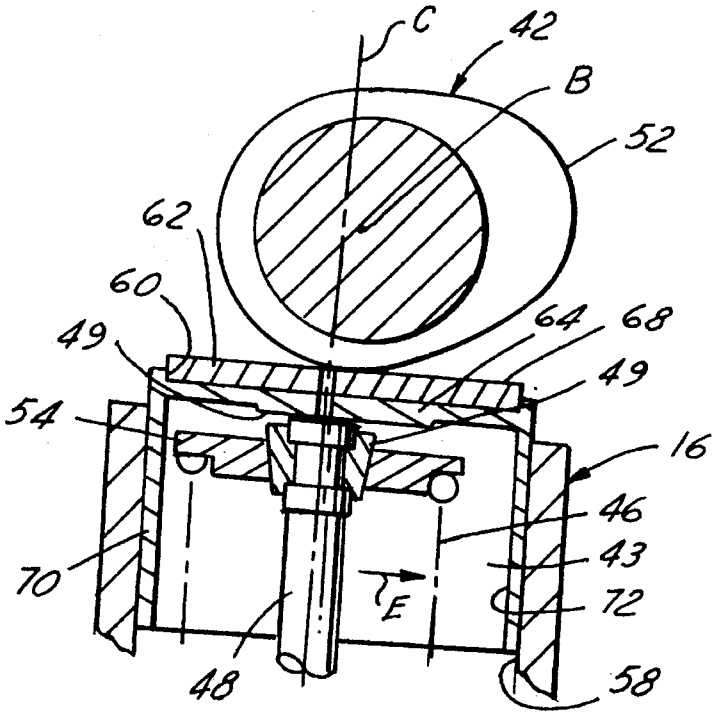
FIG. 2 is an enlarged view showing the detailed construction of one of the tappets incorporated with the air intake valves which form a part of the valve train of the cylinder head.

As seen more clearly in FIG. 2, each of the tappets 43 has the top portion thereof formed with an annular recess 60 into which a round shim 62 is inserted for use as an adjustment means to provide a predetermined "lash" between the tappet and the associated cam lobe. The shim 62 serves to compensate for manufacturing tolerances when the engine is first assembled and provides a hard wear surface for the cam lobe. The lower top portion of each of the tappets 43 is formed with a downwardly extending projection 64 which has a flat bottom surface 49 located in a plane parallel to the plane of the top surface 68 of the shim 62. The surface 49 is of sufficient diameter to allow for movement of the valve stem of the associated valve outwardly in the direction of the arrow E relative to the spark plug 26 as will be explained below. Moreover, the annular skirt portion 70 defines a cylindrical opening 72 which is sufficient in size to accommodate the aforementioned outward movement of the valve, retainer, and the coil spring.

With reference to FIG. 1, it will be noted that the center of the camshafts 40 and 42 and the longitudinal center axes of the tappets 43 are offset towards the outboard side of the cylinder head 16 with respect to the longitudinal center axes C of the intake valve 30 and the exhaust valve 28. In this case, the cylinder head construction, including the offset disposition of the camshafts 40, 42 and tappets 43, is intended for the first engine of an engine family offering engines having progressively larger cylinder bore sizes. Thus, as seen in FIG. 1, the cylinder head 16 is incorporated in an engine having a small cylinder bore and small valve option. For the companion engines with larger cylinder bore and larger valves, the engine designer need only reposition the larger valves so that their longitudinal center axes are displaced outwardly relative to the camshafts 40 and 42 and the tappets 43 while maintaining parallelism with the original position of the axes C of valves 28 and 30. In so doing, the only modification to the original cylinder head 16 for the larger bore engines would be the addition of valves having valve heads of a larger diameter, the shifting outwardly of the valve stem guides, the machining of larger valve seats, and modifications to the intake passage and the exhaust passage. This new cylinder head design for the larger cylinder bore engine, however, would not disturb the valve train drive used with the smaller cylinder bore engine. Thus, the original positions of the valve train drive consisting of the camshafts and tappets as seen in the figure of the accompanying drawing will not be disturbed so that the gears and the belts or chains remain in the same locations while providing a cylinder head for a larger cylinder bore engine with larger valves to match the increased air flow requirements while maintaining the envelope size and minimizing the cost of the conversion.

Regarding the above, it should be apparent that this invention requires that, during the design phase of an engine family starting with the small bore engine, the engine designer initially take into consideration the fact that the first engine will be part of a family of engines having progressively larger cylinder bores. With that in mind, the tappets will need to be sized, insofar as their diameter is concerned, so as to allow the outboard movement of the valves as explained above. Obviously, there will be a limitation as to extent that one can increase the cylinder bore and merely shift the larger valves outwardly, and this limitation is created by the physical presence of the adjacent cylinder.

It will be noted that in a case where the engine designer should start with a first engine of a large cylinder bore and wish to have an engine family having progressively smaller cylinder bores, the cylinder head of the first engine will have the intake valves and the exhaust valves positioned so that their longitudinal center axes C are located outboard of the rotational axes of the camshafts. At the same time, each of the inverted tappets will be sized so as to accommodate sufficient inward movement of the valve retainer and the valve compression spring. Then, for the companion engines with smaller cylinder bores and smaller valves, the engine designer need only reposition the smaller valves so that their longitudinal center axes are displaced inwardly relative to the camshafts and the tappets while maintaining parallelism with the original position of the longitudinal axes of the valves. As in the case described above in connection with the cylinder head 16, by so doing the only modification to the original cylinder head for the smaller bore engines would be the addition of valves having valve heads of a smaller diameter, the shifting inwardly of the valve stem guides, the forming of smaller valve seats, and modifications to the intake passage and the exhaust passage. This new cylinder head design for the smaller cylinder bore engine, however, would not disturb the valve train drive used with the larger cylinder bore engine. Thus, the original positions of the valve train drive consisting of the camshafts and tappets will not be disturbed so that the gears and the belts or chains remain in the same locations while providing a cylinder head for a smaller cylinder bore engine with smaller valves to fit within the smaller bore while maintaining the envelope size and minimizing the cost of the conversion.

Various changes and modifications can be made to the above described cylinder head without departing from the spirit of the invention. Such changes and modifications are contemplated by the inventor and he does not wish to be limited except by the scope of the appended claims.

The embodiments of the invention in which an exclusive property or privilege is claimed are defined as follows:

1. A cylinder head for a family of engines that maintains the same valve train drive for engines having different sized cylinder bores, said valve train drive being operatively associated with each of said cylinder bores and including a first overhead camshaft directly contacting a first inverted bucket tappet and a second overhead camshaft directly contacting a second inverted bucket tappet, an intake valve actuated by said first inverted bucket tappet and an exhaust valve actuated by said second inverted bucket tappet, said intake valve and said exhaust valve each having a valve stem having a longitudinal axis and being located in a valve stem guide formed as part of said cylinder head, one end of said valve stem being formed with a valve head for opening and closing a passage communicating through a port formed in said cylinder head with said cylinder bore, the other end of said valve stem of said intake valve and the other end of said valve stem of said exhaust valve being respectively located in said first inverted bucket tappet and said second inverted bucket tappet and having a retainer secured thereto, a spring biasing said retainer in a direction to cause the associated valve to normally close the associated passage, said first inverted bucket tappet and said second inverted bucket tappet each having a downwardly extending projection formed thereon for contacting said other end of the associated valve stem, said first overhead camshaft and said second overhead camshaft each having its rotational axis offset from said longitudinal axis of the associated valve stem and having a lobe directly contacting the associated inverted bucket tappet for causing said valve head to open said associated passage against the bias of said spring, the arrangement being such that said projection and said inverted bucket tappet associated with each of said intake valve and said exhaust valve is of a size sufficient to allow said valve stem and said spring associated with each of said intake and exhaust valves to be moved in opposite directions without disturbing the positions of said first and second camshafts and said first and second inverted bucket tappets when said cylinder head is designed for an engine having a larger or smaller cylinder bore within said family of engines.

2. A method of providing a family of engines with a cylinder head which maintains the same valve train drive for engines having progressively larger cylinder bores, said drive train including a first overhead camshaft for directly actuating a first oversized inverted bucket tappet contacting a spring-biased intake valve which has its longitudinal center axis offset inboard of the rotational axis of said first overhead camshaft, and a second overhead camshaft for directly actuating a second oversized inverted bucket tappet contacting a spring-biased exhaust valve which has its longitudinal center axis offset inboard of the rotational axis of said second overhead camshaft, said method comprising the steps of:

(a) replacing said intake valve and said exhaust valve with valves having valve heads of a larger diameter, (b) shifting the valve stem guide of said intake valve radially outwardly relative to the associated cylinder bore and shifting the valve stem guide of said intake valve radially outwardly relative to said associated cylinder bore so as to position said longitudinal center axis of each of said intake and exhaust valves towards the rotational axis of the associated overhead camshaft, (c) providing larger valve seats in said cylinder head to accommodate said valve heads of a larger diameter, and (d) enlarging the intake passage and the exhaust passage in said cylinder head to accommodate the increased air intake and exhaust gas flow therethrough.

3. A method of providing a family of engines with a cylinder head which maintains the same valve train drive for engines having progressively smaller cylinder bores, said drive train including a first overhead camshaft for directly actuating a first oversized inverted bucket tappet contacting a spring-biased intake valve which has its longitudinal center axis offset outboard of the rotational axis of said first overhead camshaft, and a second overhead camshaft for directly actuating a second oversized inverted bucket tappet contacting a spring-biased exhaust valve which has its longitudinal center axis offset inboard of the rotational axis of said second overhead camshaft, said method comprising the steps of:

(a) replacing said intake valve and said exhaust valve with valves having valve heads of a smaller diameter, (b) shifting the valve stem guide of said intake valve radially inwardly relative to the associated cylinder bore and shifting the valve stem guide of said intake valve radially inwardly relative to said associated cylinder bore so as to position said longitudinal center axis of each of said intake and exhaust valves towards the rotational axis of the associated overhead camshaft, (c) providing smaller valve seats in said cylinder head to accommodate said valve heads of a larger diameter, and (d) decreasing the size of the intake passage and the exhaust passage in said cylinder head to accommodate the lesser air intake and exhaust gas flow therethrough.

* * * * *